US009808106B1

(12) United States Patent
Bihn

(10) Patent No.: US 9,808,106 B1
(45) Date of Patent: Nov. 7, 2017

(54) SAFE ROTATABLE MAILBOX

(71) Applicant: John Bihn, Ft. Recovery, OH (US)

(72) Inventor: John Bihn, Ft. Recovery, OH (US)

( * ) Notice: Subject to any disclaimer, the term of this patent is extended or adjusted under 35 U.S.C. 154(b) by 0 days.

(21) Appl. No.: 15/360,352

(22) Filed: Nov. 23, 2016

Related U.S. Application Data

(60) Provisional application No. 62/259,571, filed on Nov. 24, 2015.

(51) Int. Cl.
*A47G 29/12* (2006.01)

(52) U.S. Cl.
CPC ..... *A47G 29/1216* (2013.01)

(58) Field of Classification Search
CPC ..... A47G 29/1216; F16M 11/08; A47C 3/18; A47C 3/185
USPC ..... 232/39; 248/131, 145, 415, 417, 418
See application file for complete search history.

(56) References Cited

U.S. PATENT DOCUMENTS 1,584,085 A 5/1926 England
1,753,506 A 4/1930 Florine
1,893,392 A 1/1933 Black
2,079,510 A 5/1937 King et al.
2,149,050 A * 2/1939 Hajicck ..... A47G 29/1216 232/39
2,550,338 A 4/1951 Dunagan
2,738,941 A 3/1956 Launch
3,161,397 A 12/1964 Nolander
3,229,940 A * 1/1966 Kagels ..... A47G 29/1216 248/124.1
3,367,613 A * 2/1968 Christensen ..... A47G 29/1216 16/313
3,407,997 A * 10/1968 Wood ..... A47G 29/1216 232/39
3,802,656 A 4/1974 Virblas
3,999,702 A 12/1976 Conroy
4,667,918 A 5/1987 Page
4,792,088 A 12/1988 Bonnell
4,955,533 A * 9/1990 Merkel ..... A47G 29/1216 232/39
5,029,783 A 7/1991 Alvarez
5,167,364 A * 12/1992 Wenning ..... A47G 29/1216 232/39
5,215,283 A * 6/1993 Gould ..... A47G 29/1216 232/39
5,411,206 A * 5/1995 Latham ..... A47G 29/1216 232/39

(Continued)

*Primary Examiner* — William Miller
(74) *Attorney, Agent, or Firm* — Ritchison Law Offices, PC; John D Ritchison

(57) ABSTRACT

A safe rotatable apparatus for supporting a rural roadside mailbox and for providing a simple, low-cost, highly rugged mounting structure which is less subject to damage due to impact from passing vehicles. The apparatus returns to its original position after a side impact. It is made of a typical mailbox; a top structural member; (c) a manner to connect the mailbox to the member; strengthening gussets attached to an outer sleeve connected to the top member and a way for connecting gussets to the top member; the outer sleeve having an opening for a pivot rod; the pivot rod held to the outer sleeve; an inner post with a rotational "sinusoidal" slice at the top end of inner post and an opening for a locking bar at the bottom of the inner post; the locking bar and a way for ballasting the locking bar such as concrete.

8 Claims, 4 Drawing Sheets

(56) References Cited

U.S. PATENT DOCUMENTS

Figure 1A:
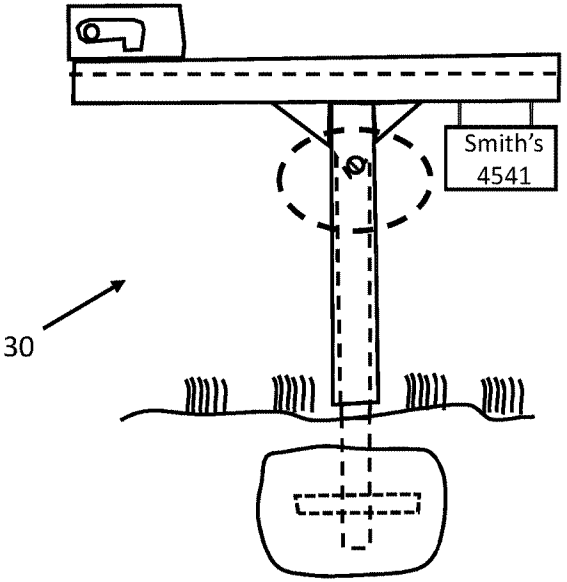

| | | | | | |
|---|---|---|---|---|---|
| 5,779,202 | A * | 7/1998 | Black | A47G 29/1216 | 232/39 |
| 6,161,756 | A * | 12/2000 | Upton | A47G 29/1216 | 232/39 |
| 7,997,545 | B2 * | 8/2011 | Holland | A47G 29/1216 | 232/39 |
| 8,047,423 | B1 * | 11/2011 | Brecht | A47G 29/1216 | 232/39 |

* cited by examiner

Section C-C

Section D-D

SAFE ROTATABLE MAILBOX

CROSS-REFERENCE TO RELATED APPLICATIONS

This application claims the benefit of U.S. Provisional Patent Application with Ser. No. 62/259,571 filed Nov. 24, 2015, by John Bihn and entitled "A Safe Rotatable Mailbox".

FIELD OF INVENTION

This invention relates to a Safe Rotatable Mailbox. and relates generally to apparatus for supporting a rural roadside mailbox and more specifically to a simple, low-cost, highly rugged mounting structure which is less subject to damage due to impact from passing vehicles. The present invention relates to a mailbox mounting device which returns to its original position after side impact. More particularly, it relates to a rotatable mailbox-supporting assembly which is inexpensive and which can be easily attached to an existing mailbox ground post and to an existing rural mailbox of the type which is approved by the U.S. Postal Service.

FEDERALLY SPONSORED RESEARCH

None.

SEQUENCE LISTING OR PROGRAM

None.

BACKGROUND and PRIOR ART

As far as known, there are no Safe Rotatable Mailbox or the like with the same features and functions as the Bihn invention. It is believed that this product is unique in its design and technologies.

BACKGROUND

Statistics show that thousands of injuries occur annually to persons while retrieving their mail from rural mailboxes located along the side of a road. Present designs of fixed, non-rotatable mailbox assemblies, while facilitating the delivery of mail, disregard the physical danger to a person who must step into the road and into traffic in order to open the mailbox and retrieve the mail from the inside of the mailbox. Thus, there is a need for a means for mounting such a mailbox so that the mail can be retrieved therefrom without a person's having to step in front of the mailbox and into the road, while at the same time allowing for the use of a regulation-type mailbox which is in current use and which is approved by the U.S. Postal Service.

In many parts of America, there exists a running battle between the roadside mailbox and the snowplow. Until now, the snowplow has usually prevailed with the mailbox ending up lying on the ground. The primary reason for the supremacy of the snowplow apparently is that most mailbox installations, by the roadside, attempt to withstand the concussion of plowed snow by using brute strength. In time, even the stronger mailbox supports begin to succumb to the battering of repeated plowings. The invention concerns roadside mailboxes. In rural areas, it is common for mailboxes to be mounted on posts at the roadside. In areas that have snow, it is common for the ground post to be set some way back from the side of the road, and for the mailbox itself to be set at the end of an arm, the arm being mounted on the ground post. The arrangement provides a clear space underneath the mailbox, so that a snow-plow blade may pass without hitting the mailbox. A problem with the common "cantilever-arm" mounting is that the margin is very tight between having the mailbox low enough so that the mailman can reach the box without getting out of the mail delivery vehicle, and yet high enough that the snow-plow blade can pass clearly underneath the mailbox. Mailboxes, as a result, are from time to time struck by snow-plows, and damaged. Another problem with the cantilever-arm mounting is that the mounting looks fragile, and looks vulnerable to damage. A cantilever-arm mailbox stands as a positive invitation to vandalism: it seems to the vandal, even a vandal with only a passing acquaintance with the rules of levers and mechanics, that he can easily break off the mounting simply by pulling on the mailbox, and of course that is true. These problems have been recognized and are addressed with the Safe Rotatable Mailbox by Bihn. Here is a cantilever-arm mounting which can allow safe retrieval of mail away from the road, that can absorb the occasional blow from a snow-plow blade, and which is difficult for a vandal to damage.

Problem Solved

The improvement and problem solved as to rural mail boxes is a rotatable device that keeps the pedestrian away from the roadside as well as avoid destruction by snow plows and vandals.

PRIOR ART

Rotatable assemblies for mounting rural mailboxes and rotatable mailboxes, per se, have been described in the prior art. For example, U.S. Pat. No. 1,584,085—England discloses a mailbox support consisting of a horizontally-extending arm having a mailbox mounted on the bottom surface of the outer end of the arm; the horizontal arm is telescopically mounted within a horizontal pipe section which is connected via an elbow to an outer sleeve telescoped on a post inserted in the ground; fixed to the post is a roller which travels in a curved slot formed in the outer sleeve, thereby permitting the horizontal arm to be elevated and to be rotated through an angle of only 90 degree. U.S. Pat. No. 3,999,702—Conroy shows a rotatable mailbox mounted on the top surface of a horizontally extending arm which is fixed to an inner tubular member telescopically inserted in an outer tubular ground post; a pin fixed to the inner tubular member rides on an inclined cam surface of the ground post so that the horizontal arm can be elevated and rotated through an angle of 180 degree; alternatively, the ground post can be telescopically inserted into the tubular member, in which case the pin would project inwardly and ride on an interior camming surface of the post. U.S. Pat. No. 2,079,510—King et al, U.S. Pat. No. 1,753,506—Florine, U.S. Pat. No. 1,893,392—Black and U.S. Pat. No. 3,802,656—Virblas also show a mailbox mounted on the outer end of a horizontally extending arm whose inner end is mounted on a vertical post having telescopic tubular members which are rotatable through an angle of 180 degree or more via the action of camming surfaces. U.S. Pat. No. 4,667,918—Page discloses a rotatable mailbox pedestal on which a mailbox is directly mountable through an angle of 180 degree, but which has a complex bearing system and a complex key-operated locking mechanism.

A variety of mailbox supports have been available heretofore, particularly for mailboxes in rural areas which are typically located near roads and are thus susceptible to damage from passing vehicles, snowplows, etc. It is desirable to provide a yieldable and/or movable support for such mailboxes. Several examples of such mailbox supports can be found. Some are simply adapted to rotate or swing out of the way upon impact, while others incorporate spring arrangements to cushion the impact and then return the support to its normal position U.S. Pat. No. 2,550,338 to Dunagan, U.S. Pat. No. 2,738,941 to Laurich, U.S. Pat. No. 3,161,397 to Nolander, U.S. Pat. No. 4,792,088 to Bonnell, and U.S. Pat. No. 5,029,783 to Alvarez are representative of the prior art. However, the prior devices have tended to be unnecessarily complicated, difficult to assemble and maintain, or have manifested other drawbacks.

SUMMARY OF THE INVENTION

This invention is a Safe Rotatable Mailbox. Taught here are the ways a mail box may be mounted on a rotatable, self-aligning structure. Here is a cantilever-arm mounting which can allow safe retrieval of mail away from the road, that can absorb the occasional blow from a snow-plow blade, and which is difficult for a vandal to damage.

The preferred embodiment of a Safe Rotatable Mailbox is comprised of: (a) a typical mailbox 33; (b) a top structural mailbox member 35 (channel I-Beam or the like); (c) a means 34 to connect the mailbox 33 to the member 35; (d) gussets 36 from an outer sleeve 40 to top member 35 and a means for connecting 37 gussets 36 to top member 35; (e) the outer sleeve 40 with an opening 41 for a pivot rod 42; (f) the pivot rod 42 and a means for holding 44 pivot rod 42 to outer sleeve 40; (g) an inner post 45 with a rotational "sinusoidal" slice 46 at top end of inner post 45 and an opening 47 for a locking bar 48 at the bottom of the inner post 45; (h) the locking bar 48; (i) a means for ballasting 49 locking bar 48 such as concrete. Also an alternative end to post 45 such as plow shear, fence post anchor and an optional sign, address, decoration 56.

The newly invented Safe Rotatable Mailbox may be manufactured at low volumes by very simple means and in high volume production by more complex and controlled systems.

OBJECTS AND ADVANTAGES

There are several objects and advantages of the Safe Rotatable Mailbox Device. There are currently no known Safe Rotatable Mailbox devices that are effective at providing the objects of this invention.

Safe Rotatable Mailbox device has various advantages and benefits:

| Item | Advantages |
|---|---|
| 1 | Provide rotatable mailbox to avoid snowplows |
| 2 | Provides a pivoting mailbox post that allows the homeowner to empty the contents of the box without entering the street and one to retrieve mail off the road |
| 3 | Has a simple, gravitational return mechanism |
| 4 | Adapts to most typical mailboxes |
| 5 | Is easily transported, assembled and installed by the homeowner |
| 6 | Provide a pivoting mailbox post that is low maintenance and does not require maintenance of the pivoting mechanism from the effects of salt, sand and water |

-continued

| Item | Advantages |
|---|---|
| 7 | Provide a pivoting mailbox post that is durable with its performance relatively independent of water, salt and sand. |

Finally, other advantages and additional features of the present Safe Rotatable Mailbox device will be more apparent from the accompanying drawings and from the full description of the device. For one skilled in the art of mailbox mounts and the like, it is readily understood that the features shown in the examples with this product are readily adapted to other types of mailbox systems and devices.

DESCRIPTION OF THE DRAWINGS—FIGURES

The accompanying drawings, which are incorporated in and constitute a part of this specification, illustrate an embodiment of the Safe Rotatable Mailbox device for various applications device that is preferred. The drawings together with the summary description given above and a detailed description given below serve to explain the principles of the Safe Rotatable Mailbox device. It is understood, however, that the Safe Rotatable Mailbox is not limited to only the precise arrangements and instrumentalities shown.

Figure 1C:
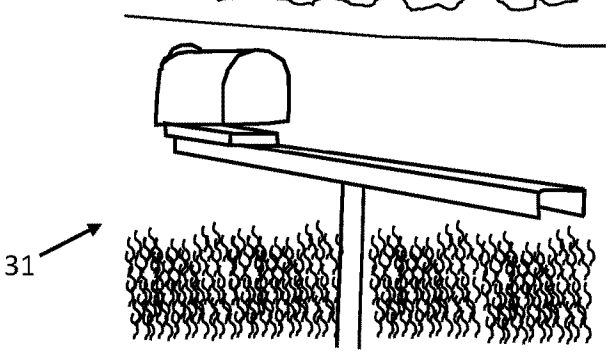
Figure 1B:
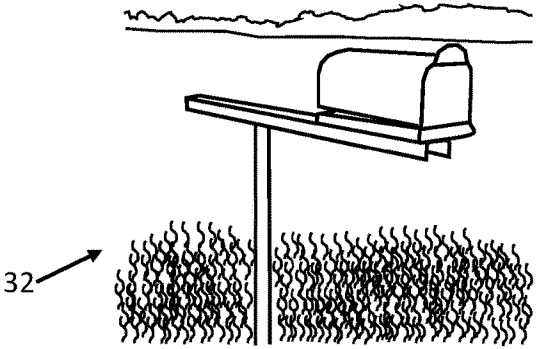

FIGS. 1 A through 1 C are sketches of the general safe, rotatable mailbox for rural applications device.

Figures 2A, 2B, 2C, 2D, 2E:
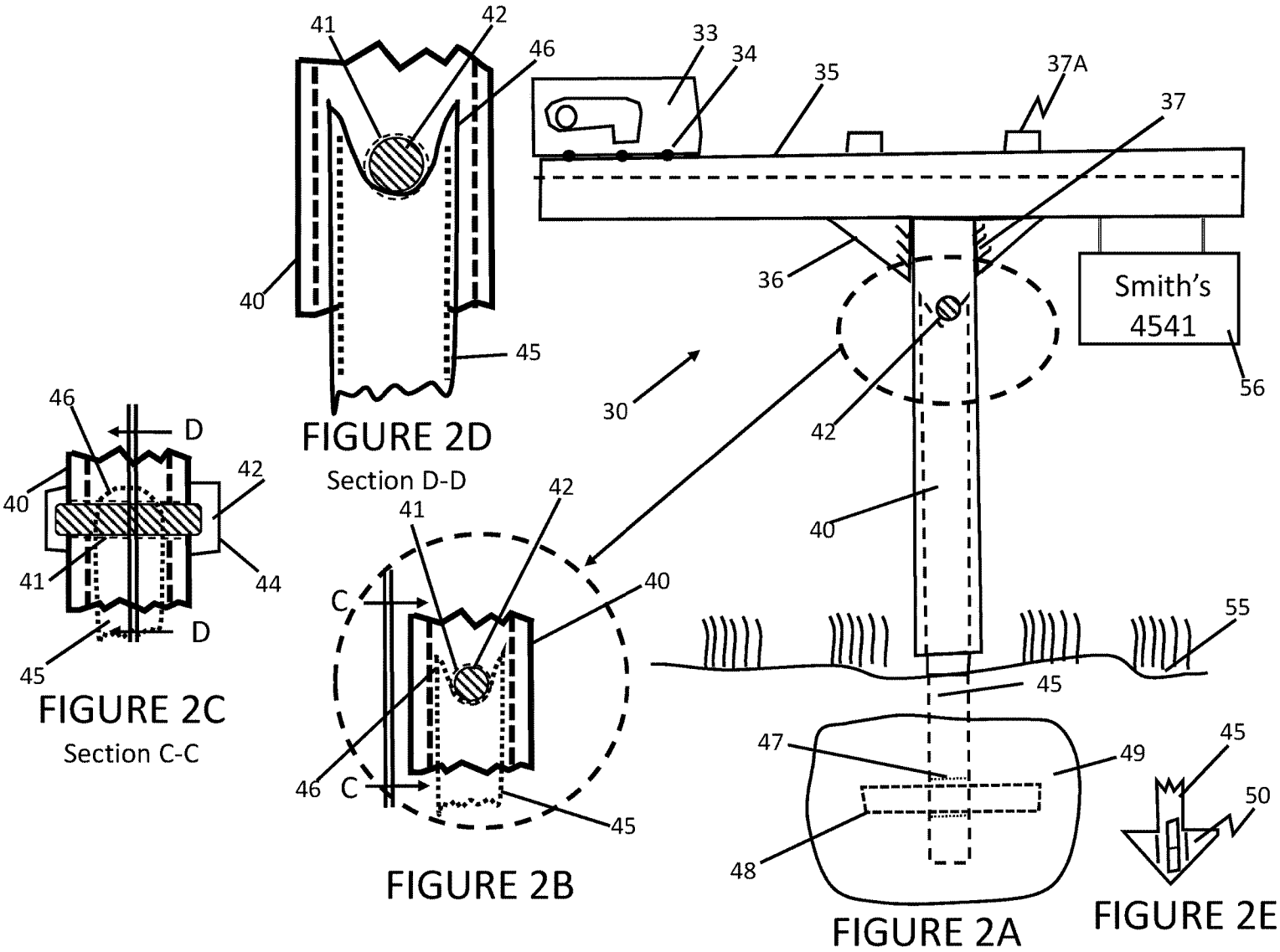

FIGS. 2 A through 2 E are sketches of the general safe, rotatable mailbox device with components and features noted.

Figure 3B:
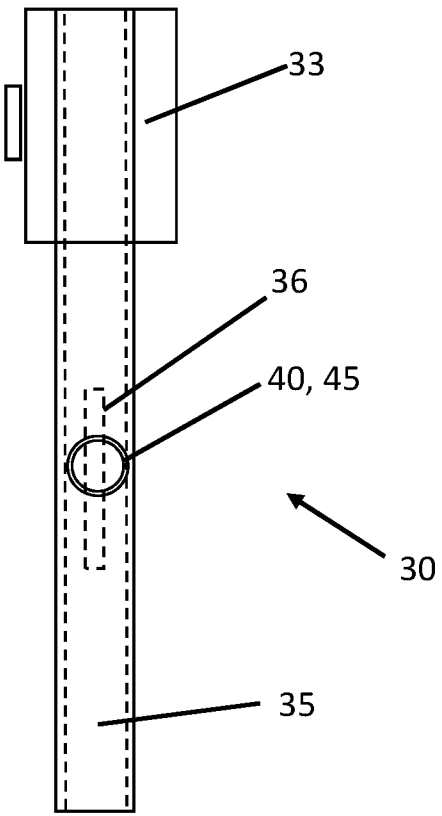
Figure 3A:
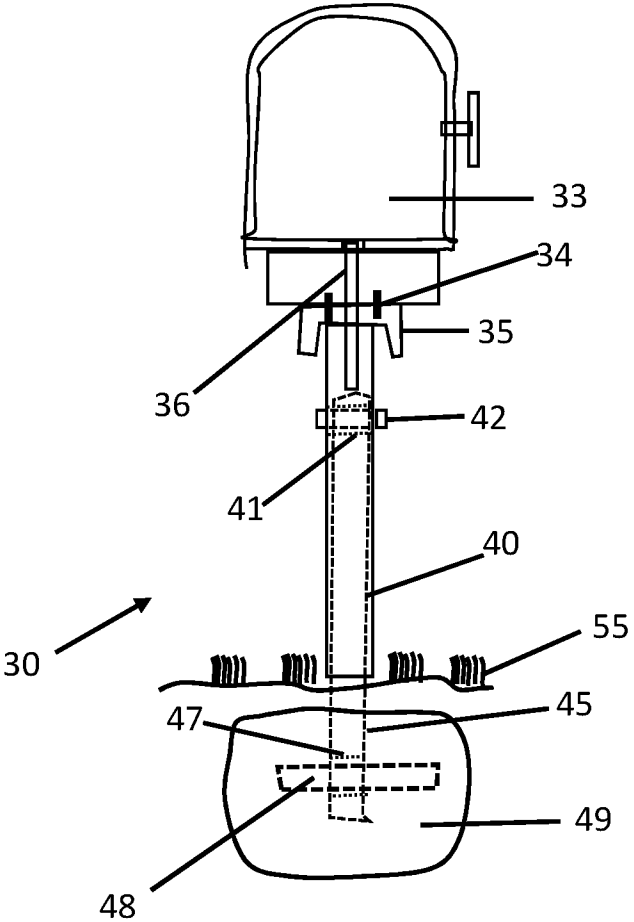

FIGS. 3 A and 3 B are sketches of safe, rotatable mailbox with the components and features shown from generally a front and top view.

Figure 4B:
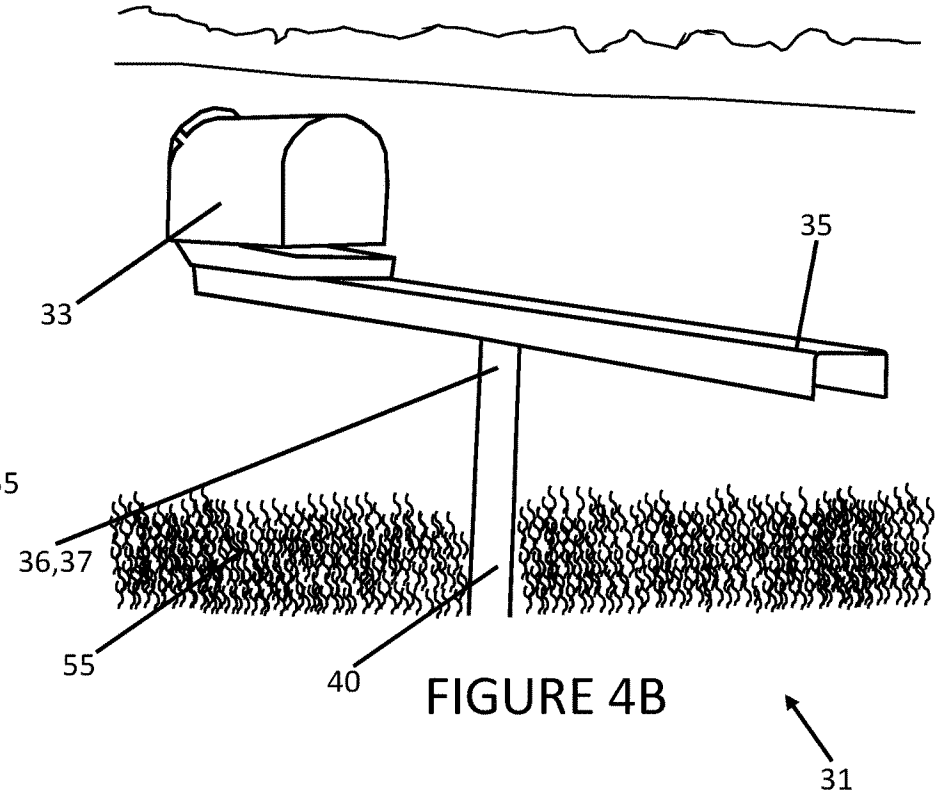
Figure 4A:
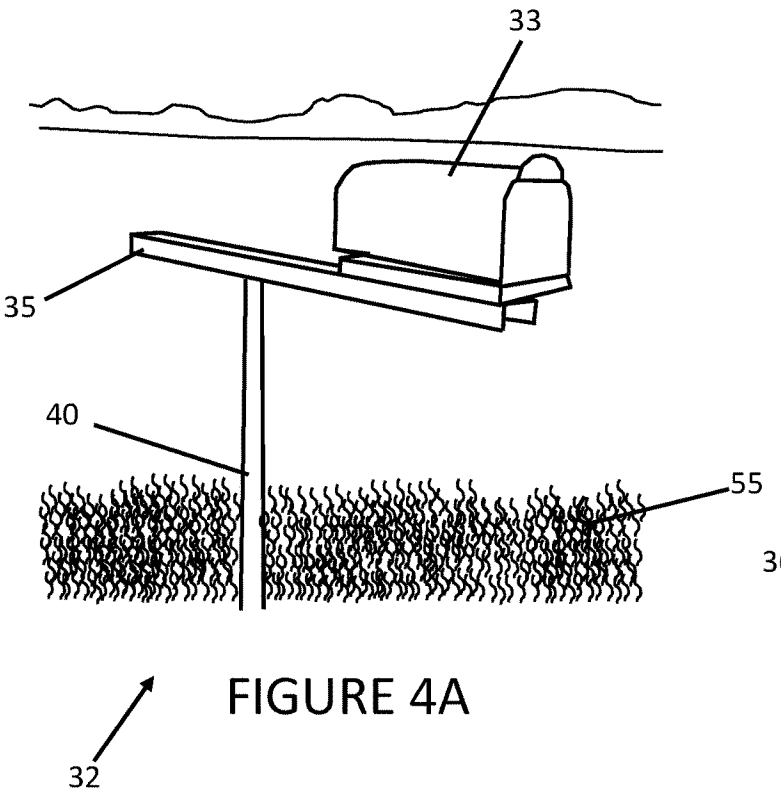

FIGS. 4 A and 4 B are photos of the prototype of the rotatable mailbox from a front and rear perspective.

DESCRIPTION OF THE DRAWINGS—REFERENCE NUMERALS

The following list refers to the drawings:

TABLE B

Reference numbers

| Ref # | Description |
|---|---|
| 30 | rotatable mailbox 30 |
| 31 | rear, side view of prototype mailbox 31 |
| 32 | front, side view of prototype mailbox 32 |
| 33 | typical mailbox 33 |
| 34 | a fastening means 34 for connecting and securing the mailbox 33 to the top member 35 (such as nails, screws, rivets, threaded bolts and nuts, cotter pins, welding, brazing, high strength adhesive/epoxy or the like) |
| 35 | top structural mailbox member 35 (channel, I-Beam, heavy and treated 4 x 4 inch timber, rectangular metal tube, or the like) |
| 36 | gussets 36 from outer sleeve 40 to top member 35 |
| 37, 37A | means for connecting 37 gussets 36 to top member 35 (fasteners, welding, molding or the like) |
| 40 | outer sleeve 40 |
| 41 | opening 41 for pivot rod 42 |
| 42 | pivot rod 42 |
| 44 | means for holding 44 pivot rod 42 to outer sleeve 40 - threaded, brazed, welded, etc. |
| 45 | inner post 45 |
| 46 | rotational "sinusoidal" slice 46 at top end of inner post 45 |
| 47 | opening or aperture 47 for locking bar 48 |
| 48 | locking cross bar 48 |

TABLE B-continued

| Reference numbers | |
|---|---|
| Ref # | Description |
| 49 | means for ballasting 49 locking bar 48 such as concrete, pea gravel in a drum; large ball of clay (30 inch sphere), steel or iron cross bars buried in the ground and connected to the locking bar, a lead mass (15-20 inch sphere), or the like. |
| 50 | alternative end to post 45 such as plow shear, fence post anchor or the like |
| 55 | ground level 55 |
| 56 | sign, address, decoration 56 etc. |

DETAILED DESCRIPTION OF PREFERRED EMBODIMENT

This invention relates to a Safe Rotatable Mailbox. and relates generally to apparatus for supporting a rural roadside mailbox and more specifically to a simple, low-cost, highly rugged mounting structure which is less subject to damage due to impact from passing vehicles. The present invention relates to a mailbox mounting device which returns to its original position after side impact. More particularly, it relates to a rotatable mailbox-supporting assembly which is inexpensive and which can be easily attached to an existing mailbox ground post and to an existing rural mailbox of the type which is approved by the U.S. Postal Service.

The advantages for the Safe Rotatable Mailbox device 30 are listed above in the introduction. Succinctly the benefits are that the device:

A. Provide rotatable mailbox to avoid snowplows
B. Provides a pivoting mailbox post that allows the homeowner to empty the contents of the box without entering the street and one to retrieve mail off the road
C. Has a simple, gravitational return mechanism
D. Adapts to most typical mailboxes
E. Is easily transported, assembled and installed by the homeowner
F. Provide a pivoting mailbox post that is low maintenance and does not require maintenance of the pivoting mechanism from the effects of salt, sand and water
G. Provide a pivoting mailbox post that is durable with its performance relatively independent of water, salt and sand.

The preferred embodiment of a Safe Rotatable Mailbox is comprised of: (a) a typical mailbox 33; (b) a top structural mailbox member 35 (channel I-Beam or the like); (c) a fastening means 34 for connecting and securing the mailbox 33 to the member 35; (d) gussets 36 from an outer sleeve 40 to top member 35 and a means for connecting 37 gussets 36 to top member 35; (e) the outer sleeve 40 with an opening 41 for a pivot rod 42; (f) the pivot rod 42 and a means for holding 44 pivot rod 42 to outer sleeve 40; (g) an inner post 45 with a rotational "sinusoidal" slice 46 at top end of inner post 45 and an opening 47 for a locking bar 48 at the bottom of the inner post 45; (h) the locking bar 48; (i) a means for ballasting 49 locking bar 48 such as concrete. Also an alternative end to post 45 such as plow shear, fence post anchor and an Optional sign, address, decoration 56.

There is shown in FIGS. 1-4 a complete description and operative embodiment of the Safe Rotatable Mailbox device. In the drawings and illustrations, one notes well that the FIGS. 1-4 demonstrate the general configuration and use of this product. The various example uses are in the operation and use section, below.

The accompanying drawings, which are incorporated in and constitute a part of this specification, illustrate an embodiment of the Safe Rotatable Mailbox device 30 that is preferred. The drawings together with the summary description given above and a detailed description given below serve to explain the principles of the Safe Rotatable Mailbox device 30. It is understood, however, that the Safe Rotatable Mailbox device 30 is not limited to only the precise arrangements and instrumentalities shown. Other examples of mailbox mountings and stands as devices and uses are still understood by one skilled in the art of mail box devices and systems to be within the scope and spirit shown here.

FIGS. 1 A through 1 C are sketches of the general safe, rotatable mailbox 30 for rural applications device. Demonstrated here are the rotatable mailbox 30; the rear, side view of prototype mailbox 31; and the front, side view of prototype mailbox 32. Details and components are shown below.

FIGS. 2 A through 2 E are sketches of the general safe, rotatable mailbox device 30 with components and features noted. Shown in these drawings and views are: a rotatable mailbox 30; a typical mailbox 33; a top structural mailbox member 35 (channel, I-Beam, heavy and treated 4×4 inch timber, rectangular metal tube, or the like) a fastening means 34 for connecting and securing the mailbox 33 to the top member 35 (fastening means such as nails, screws, rivets, threaded bolts and nuts, cotter pins, welding, brazing, high strength adhesive/epoxy or the like); a set of strengthening gussets 36 from outer sleeve 40 to top member 35; the means for connecting 37, 37A gussets 36 to top member 35 (fasteners, welding, molding or the like); an outer sleeve 40; an opening 41 for pivot rod 42; the pivot rod 42; [outer sleeve and pivot rod made of durable materials such as, for example and not limitation, metal, steel, iron, alloy steel, high strength plastic, high strength composite material]; a means for holding 44 pivot rod 42 to outer sleeve 40—threaded, brazed, welded, etc.; an inner post 45; a rotational "sinusoidal" slice 46 at top end of inner post 45; an opening 47 for locking bar 48; the locking bar 48; a means for ballasting 49 locking cross bar 48 such as concrete or the like; an alternative end to post 45 such as plow shear, fence post anchor or the like; the ground level 55; and a sign, address, decoration 56 etc.

FIGS. 3 A and 3 B are sketches of safe, rotatable mailbox 30 with the components and features shown from generally a front and top view. Components and features here are shown as a rotatable mailbox 30; a typical mailbox 33; a top structural mailbox member 35 (channel, I-Beam, heavy and treated 4×4 inch timber, rectangular metal tube, or the like); the strengthening gussets 36 from outer sleeve 40 to top member 35; an outer sleeve 40; an opening 41 for pivot rod 42; the pivot rod 42; a means for holding 44 pivot rod 42 to outer sleeve 40—threaded, brazed, welded, etc.; an inner post 45; a rotational "sinusoidal" slice 46 at top end of inner post 45; an opening 47 for locking bar 48; the locking bar 48; and a means for ballasting 49 locking cross bar 48 such as concrete, pea gravel in a drum; large ball of clay (30 inch sphere), steel or iron cross bars buried in the ground and connected to the locking bar, a lead mass (15-20 inch sphere), or the like.

FIGS. 4 A and 4 B are photos of the prototypes 31, 32 of the rotatable mailbox 30 from a front and rear perspective. Provided in these views are the following: the rear, side view of prototype mailbox 31 and the front, side view of prototype mailbox 32 of a rotatable mailbox 30; a typical mailbox 33; a top structural mailbox member 35 (channel I-Beam or the like); the strengthening gussets 36 from outer sleeve 40 to top member 35; the means for connecting 37, 37A gussets 36 to top member 35 (fasteners, welding, molding or the like); an outer sleeve 40; and the ground level 55.

The details mentioned here are exemplary and not limiting. Other specific components and manners specific to describing a Safe Rotatable Mailbox device 30 may be added as a person having ordinary skill in the field of the art of mail box devices and systems and their uses well appreciates.

OPERATION OF THE PREFERRED EMBODIMENT

The Safe Rotatable Mailbox 30 has been described in the above embodiment. The manner of how the device operates is described below. One notes well that the description above and the operation described here must be taken together to fully illustrate the concept of the Safe Rotatable Mailbox device 30. The preferred embodiment of a Safe Rotatable Mailbox is comprised of: (a) a typical mailbox 33; (b) a top structural mailbox member 35 (channel I-Beam or the like); (c) a means 34 to connect the mailbox 33 to the member 35; (d) gussets 36 from an outer sleeve 40 to top member 35 and a means for connecting 37 gussets 36 to top member 35; (e) the outer sleeve 40 with an opening 41 for a pivot rod 42; (f) the pivot rod 42 and a means for holding 44 pivot rod 42 to outer sleeve 40; (g) an inner post 45 with a rotational "sinusoidal" slice 46 at top end of inner post 45 and an opening 47 for a locking bar 48 at the bottom of the inner post 45; (h) the locking bar 48; (i) a means for ballasting 49 locking bar 48 such as concrete. Also an alternative end to post 45 such as plow shear, fence post anchor and an Optional sign, address, decoration 56.

The Safe Rotatable Mailbox device 30 operates as a rotational mail box on a post. It permits the user to rotate the rotatable device and stay away from the roadside. The device also avoids destruction by snow plows and vandals. The installation anticipates the inner post 45, locking bar 48; and ballast means 49 to be placed in a hole dug below ground level 55. Next the outer sleeve 40 is placed over the inner post 45. Next, the pivot rod 42 is placed into the opening 41 and attached to the outer sleeve 40. Optionally, the sleeve 40 and pivot rod 42 may be assembled prior to placing over the post 45. The gussets 36 and top member 35 are connected by means 37, 37A. Finally, the mail box 33 is attached to the top member 35 by means to secure 34. One skilled in assembly techniques appreciates a plethora of combinations of steps to assemble the full rotatable mailbox 30 device.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the Safe Rotatable Mailbox 30 is not to be limited to only the disclosed embodiment of product. The features of the Safe Rotatable Mailbox device 30 are intended to cover various modifications and equivalent arrangements included within the spirit and scope of the description.

What is claimed is:

1. A rotatable mailbox device comprised of:

(a) a mailbox secured to a top structural member;

(b) an outer sleeve with a set of gussets secured to the sleeve and the top member;

(c) a pivot rod and a threaded, brazed, or welded connection for holding the pivot rod to the outer sleeve;

(d) an inner post with a rotational sinusoidal shaped slice at a top end of an inner post and an aperture for a locking cross bar at a bottom of the inner post;

(e) the locking cross bar and a ballast in the ground.

2. A rotatable mailbox 30 device made of durable materials which is comprised of:

(a) a mailbox 33;

(b) a top structural mailbox member 35;

(c) a fastening means 34 for connecting the mailbox 33 to the member 35;

(d) gussets 36 from an outer sleeve 40 to the top member 35 and a threaded fastener or welding 37 for connecting the gussets 36 to the top member 35;

(e) the outer sleeve 40 with an opening 41 for a pivot rod 42;

(f) the pivot rod 42 and a threaded, brazed, or welded connection 44 for holding the pivot rod 42 to the outer sleeve 40;

(g) an inner post 45 with a rotational sinusoidal shaped slice 46 at a top end of the inner post 45 and an opening 47 for a locking bar 48 at a bottom of the inner post 45;

(h) the locking bar 48;

(i) a means for ballasting 49 the locking bar 48.

3. The device according to claim 2 further comprised of (j) a sign, address, and decoration 56.

4. The device according to claim 2 wherein the means for ballasting 49 an end to post 45 is a plow shear fence post anchor.

5. The device according to claim 2 wherein the means for ballasting 49 is selected from the group consisting of concrete, pea gravel in a drum, an approximately 30 inch large spherical ball of clay, a metal cross bar buried in the ground and connected to the locking bar, and an approximately 15 inch lead spherical mass.

6. The device according to claim 2 wherein the fastening means 34 for connecting and securing the mailbox 33 to the top member 35 is selected from the group consisting of nails, screws, rivets, threaded bolts and nuts, cotter pins, welding, brazing, and a high strength adhesive/epoxy.

7. The device according to claim 2 wherein the top structural mailbox member 35 is selected from the group consisting of a channel, an I-Beam, a heavy and treated 4×4 inch timber, and a rectangular metal tube.

8. The device according to claim 2 wherein a durable material for the outer sleeve 40, pivot rod 42, and inner post 42 is selected from the group consisting of a metal, a steel, an iron, an alloy steel, a high strength plastic, and a high strength composite material.

* * * * *